US005714938A

United States Patent [19]

Schwabl

[11] Patent Number: 5,714,938

[45] Date of Patent: Feb. 3, 1998

[54] TEMPERATURE PROTECTION DEVICE FOR AIR COOLED ELECTRONICS HOUSING

[75] Inventor: Alphonse Schwabl, St-Luc, Canada

[73] Assignee: CAE Electronics Ltd., Montreal, Canada

[21] Appl. No.: 752,324

[22] Filed: Nov. 19, 1996

[51] Int. Cl.[6] ..... G08B 17/00

[52] U.S. Cl. ..... 340/584; 340/593; 340/693; 361/106; 361/695

[58] Field of Search ..... 340/584, 588, 340/589, 693, 593, 449, 594; 361/695, 687, 103–106, 694, 688, 692, 697; 165/11.1, 80.3; 374/169; 364/550, 557

[56] References Cited

U.S. PATENT DOCUMENTS

| | | | |
|---|---|---|---|
| 4,327,397 | 4/1982 | McCleery . | |
| 4,538,201 | 8/1985 | Wuyts et al. . | |
| 4,864,283 | 9/1989 | Seto . | |
| 5,079,542 | 1/1992 | Umezawa | 340/587 |
| 5,115,225 | 5/1992 | Dao et al. . | |
| 5,132,868 | 7/1992 | Clower et al. | 361/103 |
| 5,255,149 | 10/1993 | Matsuo | 361/103 |
| 5,333,676 | 8/1994 | Mizuno | 165/13 |
| 5,355,121 | 10/1994 | Naito et al. | 340/584 |
| 5,574,667 | 11/1996 | Ding et al. | 364/557 |
| 5,612,677 | 3/1997 | Baudry | 340/584 |

*Primary Examiner*—Jeffery Hofsass
*Assistant Examiner*—Sihong Huang
*Attorney, Agent, or Firm*—Fishman, Dionne, Cantor & Colburn

[57] ABSTRACT

A temperature protection device and method for an air-cooled housing containing electronic equipment is disclosed. A fan forces air to circulate through the housing with air being expelled from the housing at a normal operating temperature inside the housing and with air at an ambient temperature being drawn into the housing. A temperature sensitive element such as a temperature sensitive switch is mounted to the housing such that it is maintained cooler than the operating temperature in the housing as a result of air being drawn into the housing and such that it is exposed to the operating temperature only upon failure of the air circulation. The temperature sensitive element or switch generates an interrupt signal when it senses a response temperature which is near the operating temperature in the housing. In the case of a temperature sensitive switch, power to the electronic equipment may be shut down by the switch. In one embodiment, the temperature sensitive element is mounted to a plate fitting in a personal computer expansion port slot, and at least one phase of the AC power is fed through a power connector on the device including a switch before being connected into the computer's AC power input connector.

20 Claims, 2 Drawing Sheets

TEMPERATURE PROTECTION DEVICE FOR AIR COOLED ELECTRONICS HOUSING

FIELD OF THE INVENTION

The present invention relates to an over-temperature protection device for electronic devices, such as computers, housed in an air-cooled electronic housing.

BACKGROUND OF THE INVENTION

Most electronic devices are designed to operate in a temperature range above room temperature, although generally, without exceeding 40° C. Operation of most electronic devices at such an extreme temperature may result in damage to the electronic equipment and more frequent repairs. Devices which protect computers or other electronic equipment from excessive temperatures are known in the art.

For example, U.S. Pat. No. 5,115,225 granted to Dao et al and assigned to Compaq Computer Corporation discloses a disk drive unit overheating warning system in which temperature sensors are located inside disk drive chambers and signal an overheating condition. The overheating condition signal triggers external alarms and produces an interrupt signal to the disk drive controller which, in turn, alerts the operating system. If the operating system does not comprehend the problem and take the appropriate action, the controller shuts down the disk drives after a certain period of time.

In U.S. Pat. No. 4,864,283 granted to Seto and assigned to Tandem Computers, Incorporated, a temperature alarm includes a thermostat for actuating an audible alarm, a control panel mounted LED and a circuit board mounted LED. The audible alarm, once actuated by the thermostat, can be temporarily disabled by the user by actuating a disable timer connected to the audible alarm. The thermostat switch disclosed in Seto is mounted along the air path through the housing adjacent to the air inlet such that the temperature alarm can be generated if the air temperature at the air inlet exceeds a chosen value such as 40° C. The thermostat switch in Seto is located below the electronic equipment and is therefore not mounted to be exposed to the operating temperature of the electronic equipment upon failure of the fan and cooling air flow.

In U.S. Pat. No. 4,327,397 granted to McCleery, a computer temperature protector is disclosed in which a thermostatic switch is arranged to shut down power supply to electronic equipment if the temperature sensed by the thermostatic switch exceeds a predetermined level. The temperature being sensed is the ambient temperature of the room in which the computer is located.

In electronic devices having a fan, failure of the fan or failure of one of a plurality of fans is the most common cause of overheating and damage to components. In the prior art devices, reliable switching off of the electronic equipment upon fan failure is not ensured.

SUMMARY OF THE INVENTION

It is an object of the present invention to provide an over-temperature protection device which becomes more sensitive to sensing temperature in the housing upon partial or complete failure of air circulation through the housing.

According to a broad aspect of the invention, there is provided a temperature protection device for an air cooled electronics housing having a fan for forcing air through the housing to expel air from the housing at a normal operating temperature inside the housing and for drawing ambient air into the housing, the device comprising: a temperature sensitive element; means responsive to the element for generating an interrupt signal when the element senses a response temperature which is near the operating temperature; mounting means for mounting the element to the housing such that the element is maintained cooler than the higher temperature of the housing as a result of the air drawn into the housing and such that the element is exposed to the operating temperature only upon failure of the fan.

The response temperature is greater than a normal ambient temperature, yet it may be lower than the operating temperature inside the housing under normal conditions. In this way, failure of the air to circulate through the housing will result more rapidly in the temperature sensitive element reaching the response temperature. The ambient temperature may be normal room temperature, or it may be air-conditioned or cooled air being fed into the housing. The fan may be mounted directly to the housing or may be part of a ventilation system used to provide cooling air to the electronic equipment housing.

According to another broad aspect of the invention, there is provided a method of protecting electronic equipment housed in an air cooled housing having forced air circulation through the housing including air expelled from the housing at a normal operating temperature inside the housing and air at an ambient temperature drawn into the housing, the method comprising the steps of: providing a temperature sensitive element to sense a temperature in the housing influenced by heat generated by the electronic equipment; cooling the element using at least part of the air drawn into the housing; generating an interrupt signal when the element senses a response temperature which is near the operating temperature; and shutting down the equipment in response to the interrupt signal to prevent further operation and overheating.

The electronic equipment may be shut down in response to the interrupt signal either by generating a warning message for an operator to shut down the equipment or by directly shutting down the equipment without operator intervention. Advantageously, a warning message can be generated before automatically shutting down the power in such a way that the operator is given a chance to shut down the computer equipment without loss of data.

According to one embodiment of the invention, the housing is a personal computer housing and the mounting means comprise a thermally conductive expansion slot output cover plate to which the temperature sensitive element is mounted. When an interface card is plugged into the expansion slot, its end plate in which cable connectors are mounted typically have a small gap or separation between the end plate and the computer housing end wall. The thermally conductive expansion slot output cover plate has such small gaps between the cover plate and the housing through which air entering the housing can pass thereby keeping the thermally conductive cover plate close to the ambient temperature. In this embodiment, air passes through the housing as a result of a fan which blows out of the computer housing and draws air into the housing through various orifices and gaps in the housing walls.

Preferably, the temperature sensitive element is a thermoswitch and the response means include a connection through the temperature switch for connecting at least one AC line of the power supply cord into the computer. Preferably, the temperature switch is provided on the inside of the computer housing.

BRIEF DESCRIPTION OF THE DRAWINGS

The invention will be better understood by way of the following detailed description of a preferred embodiment with reference to the appended drawings in which.

DETAILED DESCRIPTION OF THE PREFERRED EMBODIMENT

Figure 1:
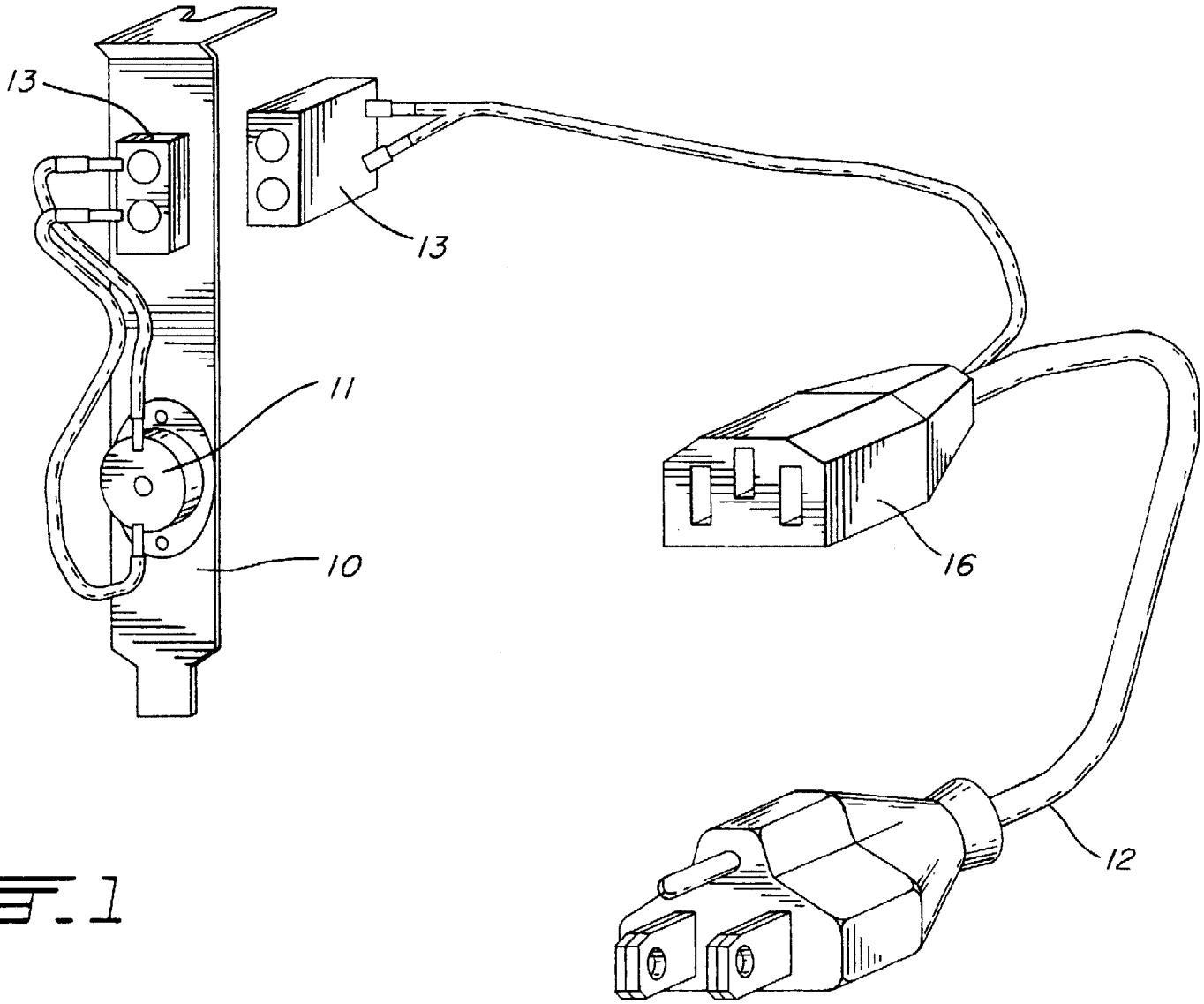
FIG. 1 illustrates the device according to the preferred embodiment including its associated power cord.

As illustrated in FIG. 1, the temperature protection device in the preferred embodiment includes a thermally conductive expansion slot output cover plate 10 made of a suitable metal having a temperature-sensitive switch 11 mounted on one side thereof so that the switch 11 is mounted inside the computer housing. The switch is normally closed and conducts the regular power supply current across the contacts in panel mount connector 13 which is a female socket connector, for example, a Molex™ 19-09-2028 connector. The power cord 12, which connects the computer device to the power mains, has a plug end for a wall socket, a recess contact plug end 16 for plugging into a socket in the computer with one phase of the AC power being fed through connector 13' which is to be plugged into the panel mounted connector 13. The connector 13' may similarly be a Molex™ connector 19-09-1029.

Figure 2:
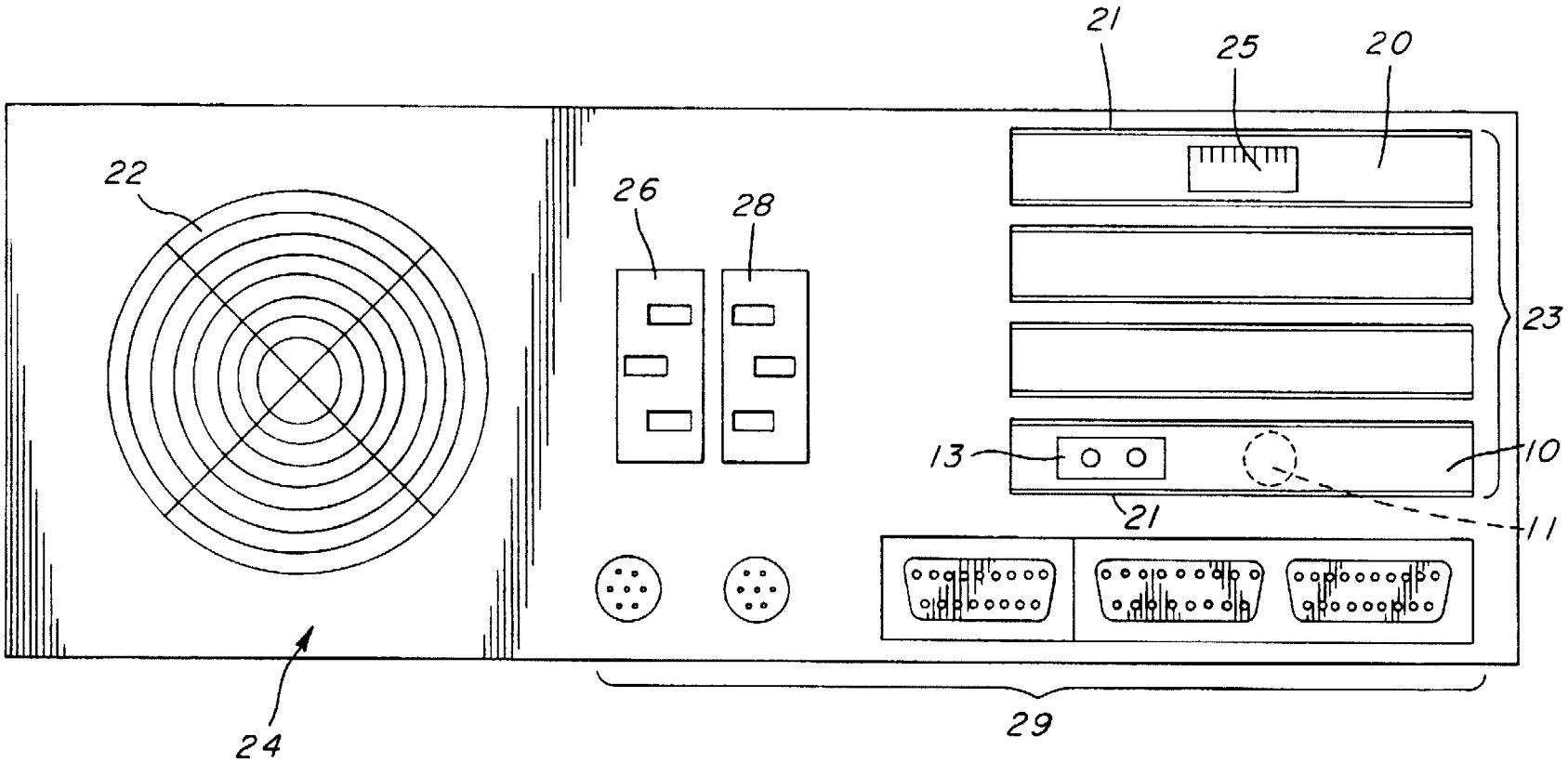
FIG. 2 is an elevation view of a rear connection panel of a desktop personal computer having four expansion slots in one of which the device according to the preferred embodiment is installed.

In FIG. 2, there is shown the rear panel 24 of a desktop computer housing including an exhaust fan 22. The exhaust fan 22 withdraws air from the housing, which air enters into the housing through a variety of orifices usually at the lower sides or front portion of the housing and including small gaps between the expansion slot cover plates or expansion slot card back plates 20. In the rear panel 24 illustrated in FIG. 2, there are four expansion slots 23 illustrated. The uppermost slot is provided with a network communication card having a backplate 20 which includes a socket 25 for a network communications cable. The middle two expansion plates in the embodiment illustrated in FIG. 2 are not used and blank cover plates are installed. Blank plates are typically installed when there is no card in the expansion slot in order to cover the hole and control air flow through the housing. In the lowermost expansion slot, device 10 is installed with the connector socket 13 being accessible and the temperature switch 11 being on the inside of the computer housing. As the fan 22 operates, the rear exposed side of plate 10 is kept substantially at ambient temperature since air circulates through the small gap 21 as air enters the housing under the negative pressure created in the housing as a result of the operation of fan 22. Alternatively, one or more small holes in plate 10 could be provided, for example, by stamping, in addition to or in place of gap 21.

In the embodiment shown in FIG. 2, a series of peripheral connector ports 29 are provided and the main power supply to the AC mains enters through a connector socket 26 and connector socket 28 is used to connect power to a video monitor.

The device illustrated in FIG. 1 is connected to the rear panel 24 by connecting connector 16 into socket 26 and then connecting connector 13' into socket 13. The power cord plug is then connected into a wall socket, surge protection device or uninterruptable power supply (UPS) as the case may be.

The temperature switch 11 may be designed to disconnect power across it at a temperature SLIGHTLY ABOVE AMBIENT ROOM TEMPERATURE, SUCH as 32° C. if designed for operation in normal air-conditioned environments, or a temperature which is slightly higher than the typical acceptable ambient temperature, such as 45° C. The metal plate 10 acts as a heat sink and averages the temperature inside the housing so that an average inside temperature is sensed by switch 11. If the operating temperature inside the housing is typically higher than the response temperature at which the switch opens, operation will continue because plate 10 will be cooled to a temperature closer to ambient temperature as a result of air being drawn into the housing. However, as soon as fan 22 fails to operate efficiently, plate 10 will be able to reach a higher temperature due to the loss of efficient cooling by air being drawn in. At this point, the switch 11 will respond promptly to the loss of efficient cooling air circulating in the housing and disconnect AC power to the computer.

As can be appreciated, many variants from the preferred embodiment are possible, however, it is preferred to construct an inexpensive device which ensures simple over-temperature protection.

Without departing from this objective, it would of course be possible to provide a connector which would fit into socket 26 which would include a socket identical to socket 26 through which power is connected through a connector such as connector 13' passing through connector 13 and switch 11. This would then allow a conventional power cord 12 to be used without needing to adapt the electrical connections in plug 16 to include the connector 13'.

It would alternatively be possible to have the temperature switch 11 permit a signal to be generated which can be read by the computer either through the communications bus of the expansion port or connected externally to relay the signals through one of peripheral connection portions 29. Software in the computer would then check for the presence of the signal and respond by giving the operator a warning message to shut down the computer.

As can also be appreciated, it is possible to integrate the temperature-protection device according to the invention into a card to be connected into an expansion slot 23 of a computer to provide on such card the additional function of over-temperature protection. In such an integrated device, the signal generated in response to detecting the over-temperature could be communicated to the operator as a message, or power could be disconnected through a connector such as 13, or both.

In the embodiment shown in FIG. 1, the temperature switch 11 is provided with a reset button which is accessible only from an inside of the housing. This is to prevent an operator from abusively overriding the temperature switch 11. In the preferred embodiment, an operator who wishes to override the temperature protection device may simply connect a standard power cord into the socket 26 thereby by-passing the device according to the invention.

What is claimed is:

1. A temperature protection device for an air cooled electronics housing having a fan for forcing air through said housing to expel air from said housing at a normal operating temperature inside said housing and for drawing ambient air into said housing, the device comprising:

a temperature sensitive element;

means responsive to said element for generating an interrupt signal when said element senses a response temperature which is near said operating temperature;

mounting means for mounting said element to said housing such that said element is maintained cooler than the higher temperature of said housing as a result of said air drawn into said housing and such that said element is exposed to said operating temperature only upon failure of said fan.

2. The device as claimed in claim 1, wherein said response temperature is lower than said operating temperature.

3. The device as claimed in claim 1, wherein said responsive means is a temperature switch connected in series with a power supply of electronic equipment contained in said housing.

4. The device as claimed in claim 1, wherein said housing is personal computer housing, said mounting means comprising a thermally conductive expansion slot output cover plate to which said element is mounted, small gaps being provided between said cover plate and said housing.

5. The device as claimed in claim 4, wherein said element is mounted on an inside of said cover plate.

6. The device as claimed in claim 3, wherein said housing is personal computer housing, said mounting means comprising a thermally conductive expansion slot output cover plate to which said element is mounted, small gaps being provided between said cover plate and said housing.

7. The device as claimed in claim 6, wherein said element is mounted on an inside of said cover plate.

8. The device as claimed in claim 6, said switch connects at least one line of a power cord supplying power to said equipment.

9. The device as claimed in claim 8, wherein said cover plate is provided with a panel mount connector, said power cord including a connector mating with said panel mount connector, said power cord having three connector ends, a first of said ends for said equipment, a second of said ends for obtaining power from a mains power source, and a third of said ends for said panel mount connector.

10. The device as claimed in claim 7, said switch connects at least one line of a power cord supplying power to said equipment.

11. The device as claimed in claim 10, wherein said cover plate is provided with a panel mount connector, said power cord including a connector mating with said panel mount connector, said power cord having three connector ends, a first of said ends for said equipment, a second of said ends for obtaining power from a mains power source, and a third of said ends for said panel mount connector.

12. The device as claimed in claim 4, wherein said response temperature is lower than said operating temperature.

13. The device as claimed in claim 6, wherein said response temperature is lower than said operating temperature.

14. The device as claimed in claim 7, wherein said response temperature is lower than said operating temperature.

15. A method of protecting electronic equipment housed in an air cooled housing having forced air circulation through said housing including air expelled from said housing at a normal operating temperature inside said housing and air at an ambient temperature drawn into said housing, the method comprising the steps of:

providing a temperature sensitive element to sense a temperature in said housing influenced by heat generated by said electronic equipment;

cooling said element using at least part of said air drawn into said housing;

generating an interrupt signal when said element senses a response temperature which is near said operating temperature; and shutting down said equipment in response to said interrupt signal to prevent further operation and overheating.

16. The method as claimed in claim 15, wherein said step of shutting down comprises generating a warning message for an operator to shut down said equipment to prevent overheating.

17. The method as claimed in claim 15, wherein said step of shutting down comprises directly shutting down said equipment without operator intervention to prevent further operation and overheating.

18. The method as claimed in claim 15, wherein said response temperature is lower than said operating temperature.

19. The method as claimed in claim 16, wherein said response temperature is lower than said operating temperature.

20. The method as claimed in claim 17, wherein said response temperature is lower than said operating temperature.

* * * * *